US007291776B2

(12) United States Patent
Dunnett

(10) Patent No.: US 7,291,776 B2
(45) Date of Patent: Nov. 6, 2007

(54) ADJUSTABLE VENTURI FOR A DRUM

(76) Inventor: Ronn J. Dunnett, 4587 57th Street, Delta, BC V4K-3E4 (CA)

( * ) Notice: Subject to any disclaimer, the term of this patent is extended or adjusted under 35 U.S.C. 154(b) by 175 days.

(21) Appl. No.: 10/993,476

(22) Filed: Nov. 22, 2004

(65) Prior Publication Data

US 2005/0120863 A1 Jun. 9, 2005

Related U.S. Application Data

(60) Provisional application No. 60/527,858, filed on Dec. 8, 2003.

(51) Int. Cl.
*G10D 13/02* (2006.01)

(52) U.S. Cl. ..... 84/411 R

(58) Field of Classification Search ..... None
See application file for complete search history.

(56) References Cited

U.S. PATENT DOCUMENTS

| | | | | | |
|---|---|---|---|---|---|
| 1,054,009 | A * | 2/1913 | Ludwig | 84/419 |
| 3,590,680 | A * | 7/1971 | Carnes et al. | 84/411 R |
| 3,842,704 | A * | 10/1974 | Prochilo | 84/267 |
| 4,214,504 | A * | 7/1980 | Rex | 84/411 R |
| 4,300,437 | A * | 11/1981 | Hinger et al. | 84/411 R |
| 4,356,757 | A * | 11/1982 | Mooy | 84/411 R |
| 4,742,753 | A * | 5/1988 | Speed | 84/414 |
| 5,157,212 | A * | 10/1992 | Fleming | 84/413 |
| 5,159,139 | A * | 10/1992 | Beals et al. | 84/414 |
| 5,419,230 | A * | 5/1995 | Ocheltree et al. | 84/415 |
| 5,427,009 | A * | 6/1995 | LaPlante | 84/413 |
| 6,069,307 | A * | 5/2000 | Rogers | 84/411 R |
| 6,093,877 | A * | 7/2000 | Nickel | 84/415 |
| 6,121,528 | A * | 9/2000 | May | 84/411 R |
| 6,198,033 | B1 * | 3/2001 | Lovelett | 84/411 R |
| 6,211,448 | B1 * | 4/2001 | Shigenaga et al. | 84/411 R |
| 6,380,468 | B1 * | 4/2002 | Shigenaga | 84/411 R |
| 6,407,322 | B1 * | 6/2002 | Kuppers | 84/411 R |
| 6,515,208 | B2 * | 2/2003 | Cleland | 84/411 R |
| 6,700,044 | B1 * | 3/2004 | Bencomo, Jr. | 84/411 R |
| 6,927,330 | B2 * | 8/2005 | May | 84/411 R |
| 6,949,701 | B2 * | 9/2005 | Okumura | 84/411 R |

* cited by examiner

*Primary Examiner*—Lincoln Donovan
*Assistant Examiner*—Robert W. Horn
(74) *Attorney, Agent, or Firm*—Matthew W. Jellett; Hughes Law Firm, PLLC

(57) ABSTRACT

A vent for a drum or drum head is provided. The vent includes a valve which is mounted on the side of the drum or drum head which can be adjusted between fully open and fully closed positions and may provide a range of settings between those two positions. A number of embodiments of adjustable throttle valve types that are applicable including but not limited to: globe valve, gate valve, ball valve, plug valve butterfly valve, diaphragm valve, check valve, one, two or three way valves, pinch valve, flap valve, needle valve or safety valve.

7 Claims, 5 Drawing Sheets

FIG. 1a.
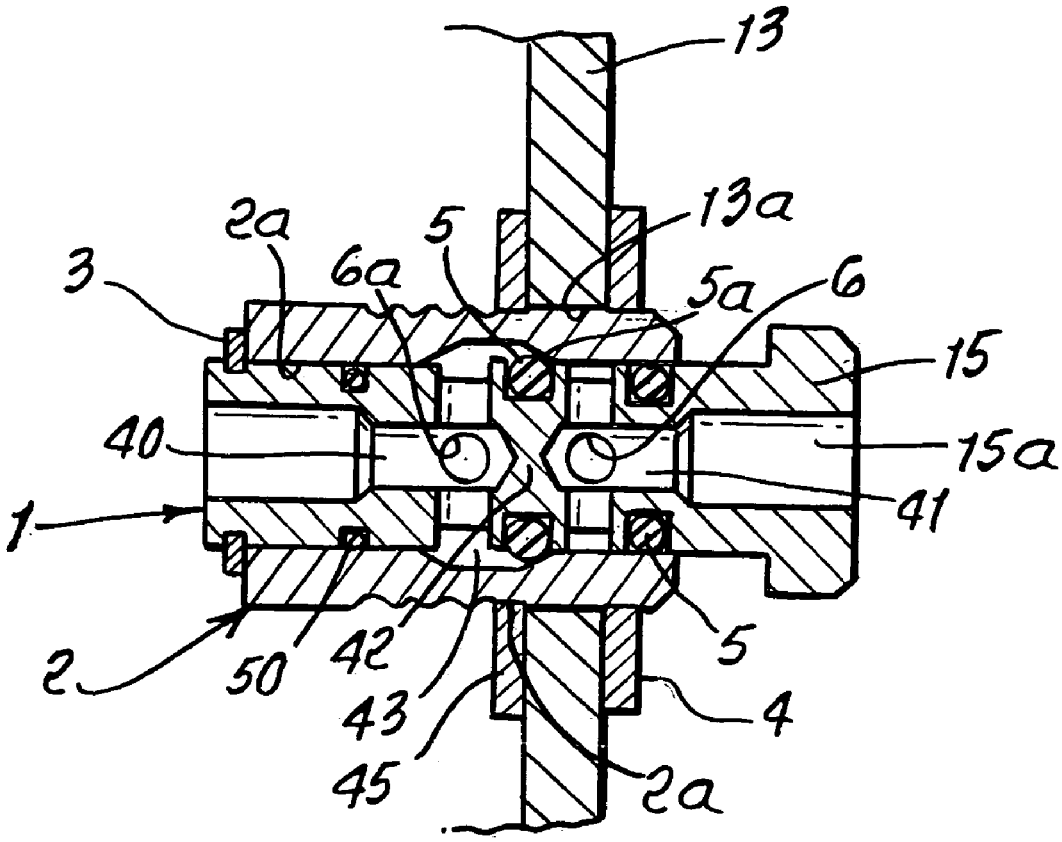
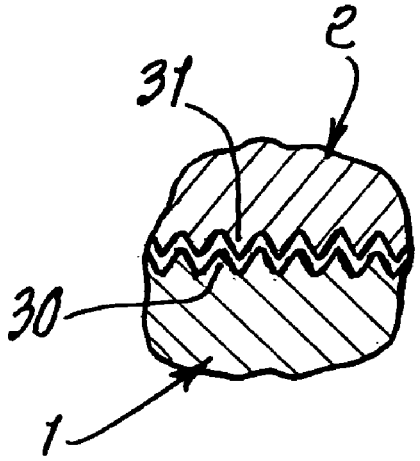
FIG. 1b.

ADJUSTABLE VENTURI FOR A DRUM

This application claims priority from provision application Ser. No. 60/527,858, filed Dec. 8, 2003.

BACKGROUND OF THE INVENTION

This invention relates to venting of musical drums, and more particularly concerns ways to allow the drummer or percussionist to adjust and control or modulate the air flow and vibration that exits or remains inside the drum, thus altering the response, sensitivity, resonance and tone of the drum. The invention also concerns establishing a threshold which, when achieved, will result inventing self-actuation. The invention can be used on a variety of percussive instruments such as snare drums, tom toms, bass drums and tympani and on drum heads.

DESCRIPTION OF RELATED ART

Conventional methods of venting a drum have involved drilling a permanent hole or port in the shell, the rationale being that this allowed for freedom of vibration of the drum head and as a means for air and vibration to escape. In some cases a rubber stopper or similar device was provided to plug the hole. As an alternative no holes or ports for the purpose of venting were installed. Both methods of venting or lack thereof produce a different set of characteristics such as response, tone and sensitivity of the drum all of which are affected by air and vibration that remain in or are expelled from the drum when it is struck. However, neither of these methods provide the user with the option to switch between full opening and full closing of drum venturi vents, nor to they offer control over a wide range of variables between fully open and fully closed drum vents, The present invention, directed to an adjustable vent, affords all of such options to the user.

SUMMARY OF THE INVENTION

This invention is directed to an air throttling valve, on a drum that allows the user to control and modulate the movement of air and vibration that travels into and out of the drum by either a manual static adjustment or by setting a self-actuation threshold. A benefit of this invention consists in that the valve threshold can be adjustably set, thus allowing the release of internal air and sound pressure according to the level of pressure inside the drum. A further benefit of this invention is provision of a vent for a drum having a mechanism that can be secured in a fully opened or fully closed position. Another benefit is that it allows the user to adjust the aperture size of the vent thus allowing for an infinite number of settings that range between fully open and fully closed. An additional benefit is that the adjustable can be fitted into a previously installed opening in a drum. An added benefit of the invention is that it allows for the expansion and contraction of drum heads made from organic membranes. Another benefit of this invention is the adjustable vent can be incorporated into another component of the drum that is attached to the drum shell. A further advantage is provided in that the valve can be completely removed to allow for a microphone to be inserted into the drum cavity. A further benefit is that it provides a pressure release mechanism for a drum that may experience a change in internal or external pressure due to altitude or temperature. Yet another advantage consists in that the valve can be self-activating, and the threshold or tolerance can be set to allow for internal air pressure release under varying playing levels. All or parts of the valve can be removed to allow for traditional open hole venting, and the valve can be fitted to a drum head.

Basically, the invention is embodied in:

a) a drum having a drum head to be struck by a beater, creating enhancement of air pressure within the drum, b) and an adjustable valve carried on the drum and having a means for adjusting venting of air pressure from within the drum to the drum exterior, c) the valve including an air flow throttling component or components.

As will be seen, the valve may typically be carried by a shell defined by the drum; and the adjusting means may include a movable adjuster for varying the flow of air through the valve from the drum interior to the drum exterior. The valve may have a body extending in the drum shell, as in an opening in the shell, and the adjuster then typically extends from within the adjusted body to the exterior, for manual displacement between selected positions to control the venting.

Another object is to provide the adjuster in the form of an axially movable adjustable stopper, and a seat engageable by the stopper, the stopper accessible from the drum exterior. The adjuster may preferably have radially extending air flow throttling holes that communicate with the drum exterior, and the adjuster may have axial porting that communicates with the vent holes and the drum interior.

A further object includes provision of the adjuster in the form of a tubular spool received for axial movement in a valve body bore, there being first and second O-rings on the spool, with a primary channel in the spool and between such O-rings to receive flow from the tubular spool, there being a secondary channel in the valve body to receive flow from the primary channel, and there being a tertiary channel in the spool to receive flow from the secondary channel for venting to the exterior via a selected port in the spool.

In addition, means to hold the adjuster in different positions may be provided to adjust throttling action, to allow different drumming sound effects.

These and other objects and advantages of the invention, as well as the details of the illustrative embodiment, will be more fully understood from the following specification and drawings, in which:

DRAWING DESCRIPTION

FIG. 1 is a cross-sectional view of one embodiment of the invention in the open position and mounted to the drum shell;

FIG. 1*a* is a fragmentary section showing a closed position of the FIG. 1 valve;

FIG. 1*b* is a fragmentary section showing detenting means to hold a valve spool in selected position for adjustable venting;

DETAILED DESCRIPTION

Figure 1:
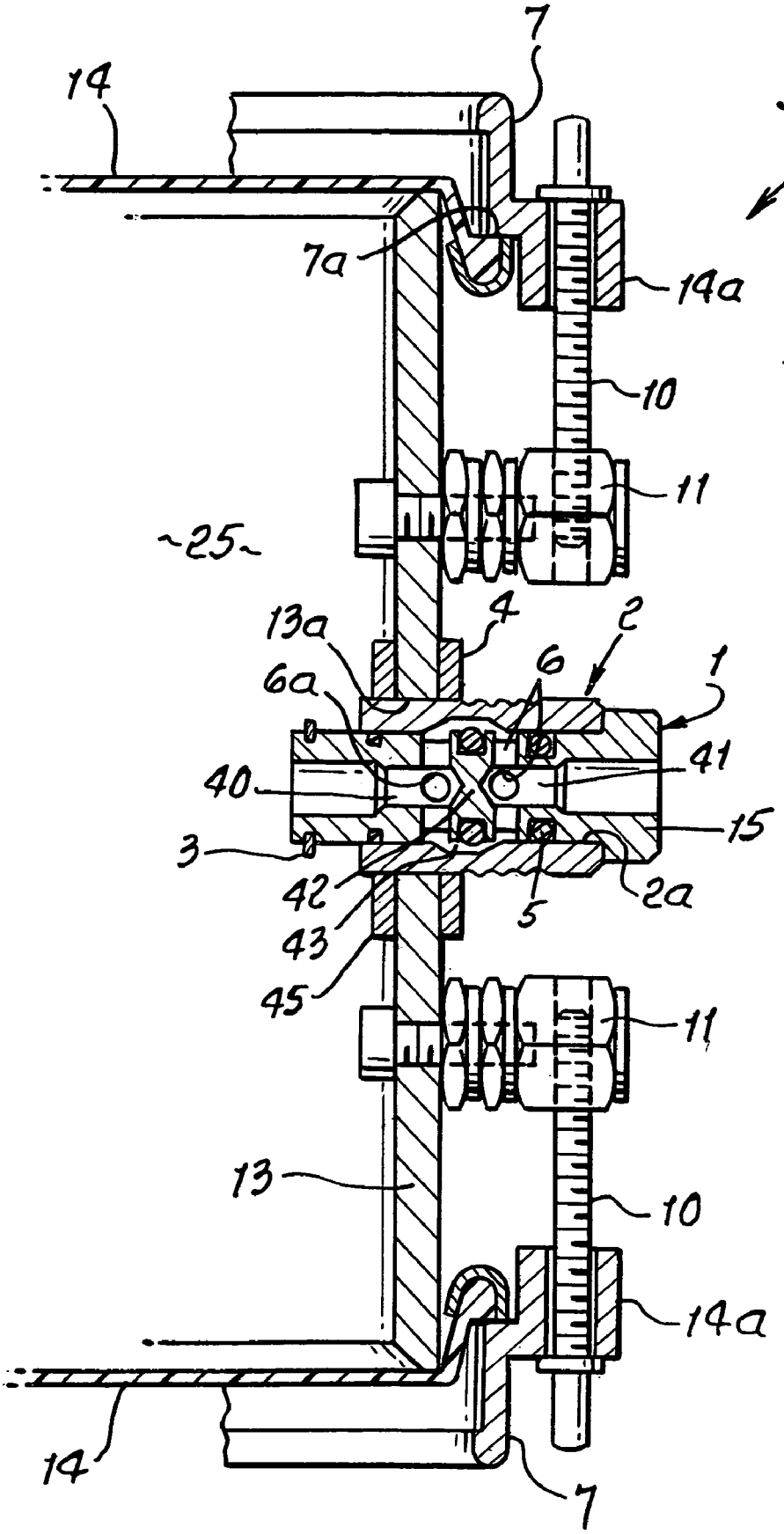

FIG. 1 of the drawings shows a drum 9, comprised of a drum shell 13, to which are attached a series of lugs 11. The drum heads 14 are held in place by the hoops 7 that press down on the head retainer at 7*a*. Tension is applied to the drum heads 14 by flange 14*a* and adjustable tension rods 10 that engage the hoops and that are threaded into the lugs 11.

The spool valve 2 is installed into hole 13*a* in shell 13 and held in place by a retaining annular clip 4. The adjustable throttle body 1 is installed into the bore 2*a* of valve 2 and contains series of channels around the circumference into which are fitted rubber gaskets or O-rings 5. A series of radial holes 6 around the circumference of the tubular throttle body 1 allow for the flow of air and vibration between body bore sections 40 and 41, and around bore restriction 42, and via by-pass channel 43, when the throttle body 1 is moved to the open position, seen in FIG. 1 by way of a knob 15 on one end of the throttle body 1. In FIG. 1 position, air in the drum interior 25 is pushed by drum head deflection, and with throttling action, through the bore section 40, through holes 6*a* in body 1, then through channel 43 in valve body 2, then through holes in throttle body 1, and then to the exterior via porting 41 in the body 1 and port 15*a* in the knob. A metal retaining clip 45 is inserted into a channel around the circumference of the throttle body 1 at the opposite end of the knob 15, to engage the inner end 2*a* of the body 2, in closed position of the valve as seen in FIG. 1*a*. Detenting such as interengageable serrations 30 and 31 on 1 and 2, as seen in FIG. 1*b*, can be provided to retain the body in any selected intermediate position, of varied and selected flow throttling. O-ring 50 seals off between 1 and 2. Clip 3 limits pulling of body 2 as in FIG. 1*a*, at which time an O-ring 5 engages a seat 5*a*.

Figure 2:
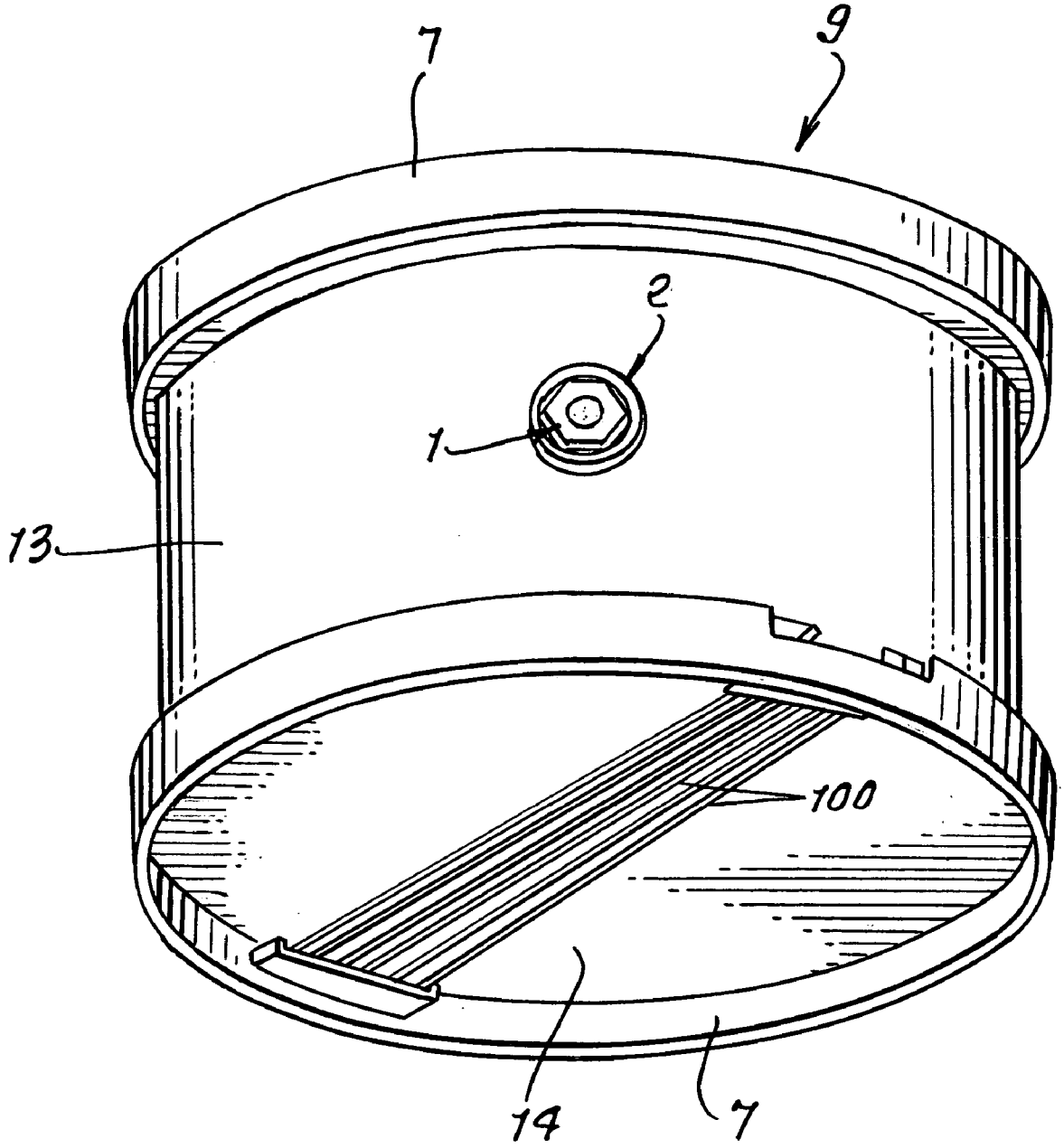
FIG. 2 is a bottom perspective view of the drum shell with one embodiment of the invention mounted to the shell.

FIG. 2 of the drawings shows the throttle body 1 installed into the valve 2 which is installed into the shell of the drum, in this example a snare drum. As is conventional a snare drum includes a shell 13 with a set of snares or wires 100 positioned against the bottom drum head 14.

In the embodiments of the invention in FIG. 1 and FIG. 2, the valve is adjusted by pushing or pulling the throttle body 1 until the desired characteristics are achieved.

Figure 3:
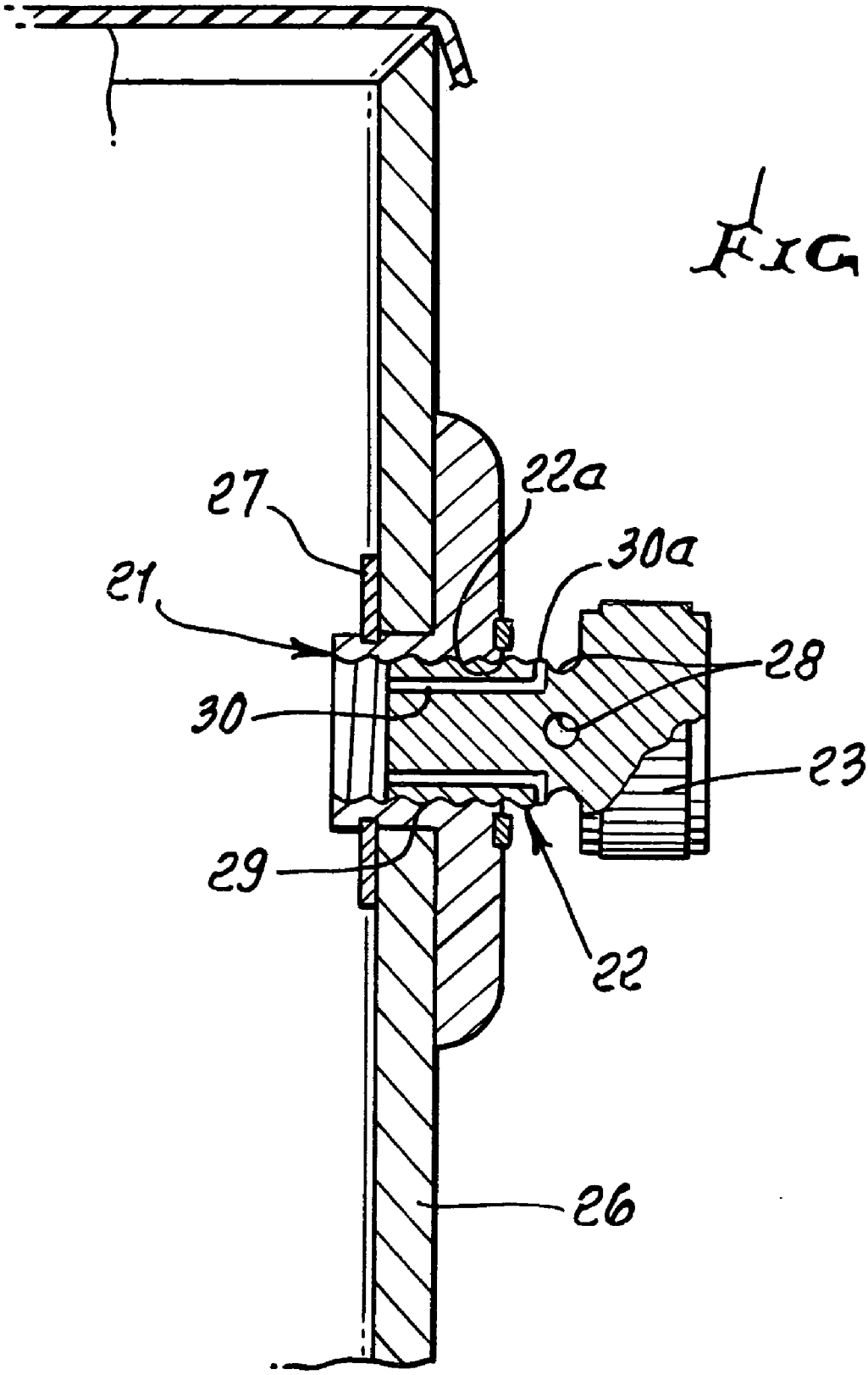
FIG. 3 is a cross-sectional view of the invention in an alternate embodiment.

FIG. 3 of the drawings shows the valve 21, including the throttle body 22 attached to the drum shell 26 and held in place by a retaining clip 27. The valve throttle body threads at 29 into the valve. A series of holes 28 are placed around the circumference of the throttle body 22. The exterior portion of the throttle body 22 has an adjustment knob 23 at the end. Air in the drum escapes via port 30, when the port exit 30*a* is retracted past edge 22*a* of body 22.

Figure 4:
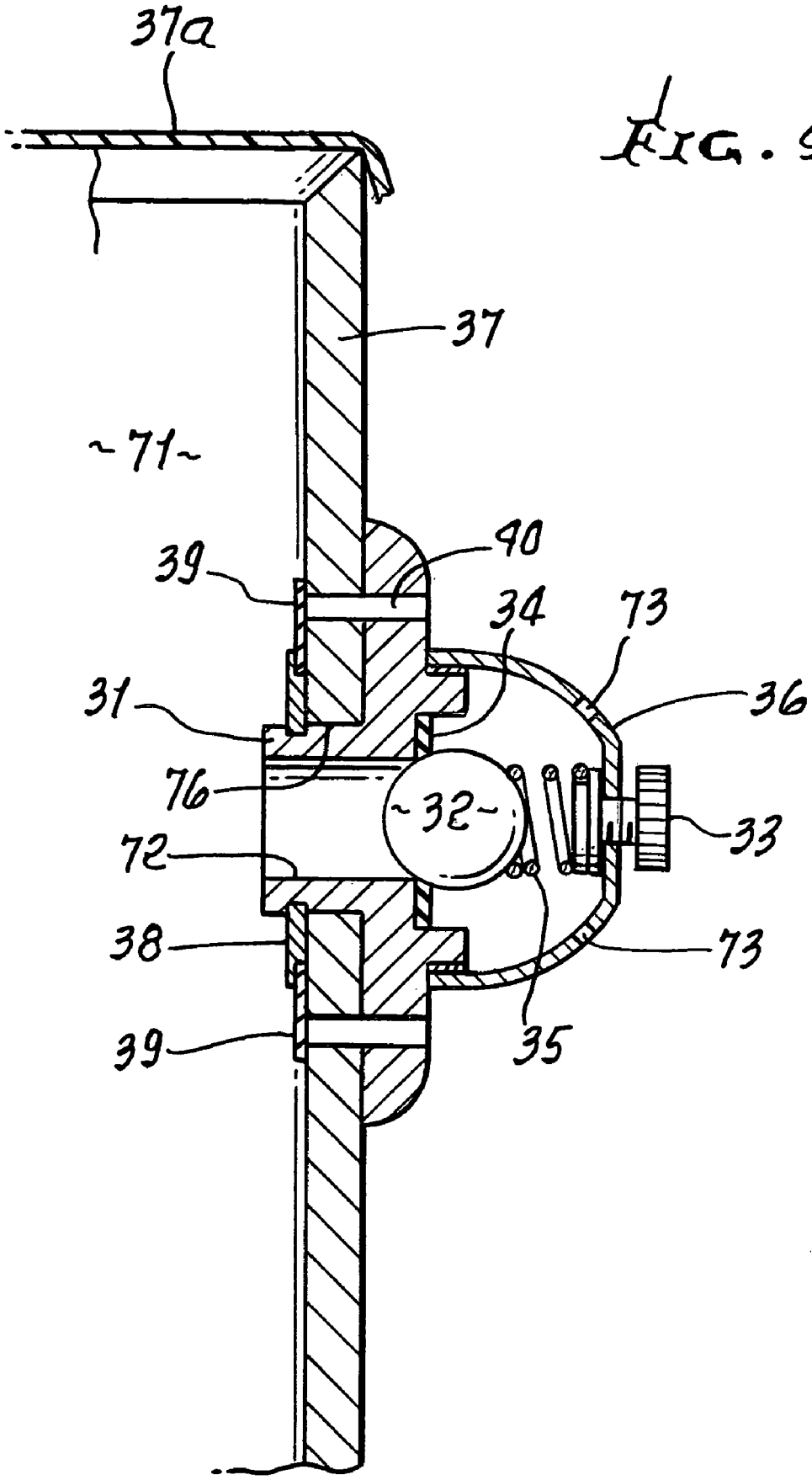
FIG. 4 is a cross-sectional view of the invention in another and alternate embodiment.

FIG. 4 of the drawings shows another embodiment of the invention wherein the valve 31 is attached to a bore 76 in the drum shell 37 by a valve attachment clip 38. The throttle body ball 32 is held against the rubber seal 34 by a compression spring 35. The threshold control knob 33 is threaded into the valve exhaust cap 36. The one way air re-intake valve 40 is covered on the inside of the shell by a rubber seal 39 which is held in place by the valve attachment clip 38. Seal 39 deflects upon air re-intake. A drum head is schematically shown at 37*a*, and when it is deflected toward the drum shell interior 71, air exhausts via valve bore 72, the throttling exhaust post opened when the ball deflects to the right, and vents 73 in cap 36. Throttling at the exhaust post is adjusted by turning of knob 33, to variably compress the spring.

I claim:

1. In combination, a) a drum having a drum head to be struck by a beater, creating enhancement of air pressure within the drum, b) and an adjustable valve carried on the drum and having a means for adjusting venting of air pressure from within the drum to the drum exterior, c) said valve including an air flow throttling component or components;

d) said valve is carried by a shell defined by the drum;

e) said means includes a movable adjuster for varying the flow of air through the valve from the drum interior to the drum exterior;

f) said valve includes a body attached to the drum to extend in the shell, said adjuster extends from within the body to the exterior, for manual displacement between selected positions to control said venting;

g) said adjuster having radially extending air flow throttling holes that communicate with the drum exterior via a by-pass channel, and the adjuster has axial porting that communicate with said throttling holes and the drum interior.

2. The combination of claim 1 wherein the stopper has an axis of rotation, the throttling holes spaced about said stopper axis of rotation.

3. In combination, a) a drum having a drum head to be struck by a beater, creating enhancement of air pressure within the drum, b) and an adjustable valve carried on the drum and having a means for adjusting venting of air pressure from within the drum to the drum exterior, c) said valve including an air flow throttling component or components;

d) said valve has a tubular spoof and a body defining a bore receiving the spool, there being first and second O-rings on the spool, first radial ports proximate the O-rings to receive flow from the drum interior via the tubular spool, there being a by-pass channel in the body to receive flow from said first radial ports, and there being a second radial ports and proximate the O-rings in the spool to receive flow from the by-pass channel for venting to the exterior via a port in an adjusting knob, said first and second ports acting as throttling means.

4. In combination, a) a drum having a drum head to be struck by a beater, creating enhancement of air pressure within the drum, b) and an adjustable valve carried on the drum and having a means for adjusting venting of air pressure from within the drum to the drum exterior, c) said valve including an air flow throttling component or components;

d) detenting for holding the adjuster in any one of a number of position corresponding to different tonal effects produced during drumming.

5. The combination of claim 4 wherein there are multiple of said radial ports in the spool and at opposite sides of a flow restrictor extending cross-wise of the spool axis.

6. In combination, a) a drum having a drum head to be struck by a beater, creating enhancement of air pressure within the drum, b) and an adjustable valve carried on the drum and having a means for adjusting venting of air pressure from within the drum to the drum exterior, c) said valve including an air flow throttling component or components;

d) said valve includes a body attached to a shell defined by the drum, said adjuster threaded into said body to allow adjuster rotation for controlling throttling.

7. In combination, a) a drum having a drum head to be struck by a beater, creating enhancement of air pressure within the drum, b) and an adjustable valve carried on the drum and having a means for adjusting venting of air pressure from within the drum to the drum exterior, c) said valve including an air flow throttling component or components;

d) said valve includes a body attached to a shell defined by the drum, said adjuster including a spring urged ball seated on a seat, and past which air can escape after deflecting the ball toward the spring, there being a control knob to variably compress the spring between multiple selected portion.

* * * * *